US006534909B1

(12) United States Patent
Kim

(10) Patent No.: US 6,534,909 B1
(45) Date of Patent: Mar. 18, 2003

(54) IMPLOSION PROTECTION BAND FOR COLOR CATHODE RAY TUBE

(75) Inventor: Do Hoon Kim, Taegu-shi (KR)

(73) Assignee: LG Electronics Inc., Seoul (KR)

( * ) Notice: Subject to any disclaimer, the term of this patent is extended or adjusted under 35 U.S.C. 154(b) by 164 days.

(21) Appl. No.: 09/637,918

(22) Filed: Aug. 14, 2000

(30) Foreign Application Priority Data

Aug. 13, 1999 (KR) ..... 99-33433

(51) Int. Cl.[7] ..... H01J 29/86; H01J 29/87; H01J 31/00

(52) U.S. Cl. ..... 313/482; 313/477 R; 313/478; 313/495; 220/2.1 A; 220/2.3 A; 220/2.1 R

(58) Field of Search ..... 313/482, 477 R, 313/478, 402, 408, 495; 220/2.1 A, 2.3 A, 2.1 R, 2.3 R

(56) References Cited

U.S. PATENT DOCUMENTS

| | | | | | |
|---|---|---|---|---|---|
| 4,720,657 | A | * | 1/1988 | Tischer | 220/2.3 A |
| 4,930,015 | A | * | 5/1990 | Dougherty et al. | 313/477 R |
| 4,990,825 | A | * | 2/1991 | Tsukui et al. | 313/479 |
| 5,241,394 | A | * | 8/1993 | Mutso et al. | 250/214 VT |
| 5,606,377 | A | * | 2/1997 | Swank | 248/229.16 |

* cited by examiner

*Primary Examiner*—Ashok Patel
*Assistant Examiner*—Sikha Roy
(74) *Attorney, Agent, or Firm*—Fleshner & Kim, LLP

(57) ABSTRACT

Implosion protection band for color cathode ray tube having a panel with a wedge ratio of 1.1~1.8 and a substantially flat outer surface, wherein the implosion protection band is strapped around an outer circumference of the panel to satisfy a condition of $0.2 \leqq UW/LW \leqq 0.5$, where the UW denotes an upper band width and the LW denotes a lower band width with reference to an extension line from an inside surface of the panel at a center thereof, thereby reducing a maximum stress on the panel by approx. 5%~7% compared to the same in the related art and improve an implosion proof characteristics.

10 Claims, 4 Drawing Sheets

IMPLOSION PROTECTION BAND FOR COLOR CATHODE RAY TUBE

BACKGROUND OF THE INVENTION

1. Field of the Invention

The present invention relates to a cathode ray tube, and more particularly, to an implosion protection band for a color cathode ray tube, which is fastened to an outer circumference of the cathode ray tube for enhancing implosion proof characteristics.

2. Background of the Related Art

Referring to FIG. 1, in general the color cathode ray tube is provided with a panel 1 having R, G, B fluorescent films 1*a* coated on an inside surface, a funnel 2 welded to a rear end of the panel for maintaining vacuum in an inside space thereof, an electron gun(not shown) sealed in a neck part 2*a* of the funnel for emitting electron beams 3, a deflection yoke 4 for deflecting the electron beams emitted from the electron gun, and a shadow mask 5 for selection of a color of the electron beams deflected by the deflection yoke. The shadow mask 5 is supported on a support frame 6, so as to have a gap to the fluorescent film 1*a*. In order to make the electron beams 3 emitted from the electron gun to hit a target on the fluorescent film 1*a* exactly, an inside space of the cathode ray tube should be maintained to be a high vacuum. Accordingly, an evacuation step is carried out, in which air inside of the cathode ray tube is evacuated while the electron gun is inserted into the neck park 2*a*. However, as shown in FIG. 2, upon completion of the evacuation step, the panel 1 has substantial amounts of tension and compression exerted thereto. That is, the cathode ray tube is susceptible to implosion even if a slight impact is applied thereto. Therefore, in order to prevent this, an implosion protection band 11 is strapped around a skirt portion of the panel 1 before the evacuation. FIGS. 3A and 3B illustrate stress simulations of a panel 1 of a cathode ray tube under a high vacuum, wherein portions with high stresses are sensitive to impacts and have high probabilities of implosions.

In general, the implosion protection band 11 is strapped by a method as shown in FIG. 4.

First, an implosion protection band 11 having an inner circumference slightly shorter than an outer circumference of the panel 1 is provided.

Second, the implosion protection band is heated until the inner circumference of the implosion protection band 11 becomes longer than the outer circumference of the panel 1.

Third, the implosion protection band is inserted in the outer circumference of the panel 1 and the implosion protection band is cooled down, to complete the strapping.

At the end, the uniform compression of the four comers by the implosion protection band 11 disperses the stresses distributed in a screen portion of the panel 1 during the vacuum. As alternatives to the implosion protection band, the panel 1 may be heat treated to strengthen the panel 1 physically, or a film is attached on a surface of the panel. A position of the implosion protection band strapping on the skirt portion of the Panel 1 differs depending on a shape of the panel 1. As shown in FIG. 5, a parameter influencing to the strapping position of the implosion protection band 1 is an "wedge ratio=S/t", a ratio of a corner thickness 'S' of the panel 1 to a center thickness 't' of the panel 1 in an effective surface thereof. The wedge ratio, dependent on an inner surface curvature and an outer surface curvature as well as the center thickness't' of the panel 1, is in general 2.0.

Recently, as screen of the cathode ray tube is large sized and flatter, it has been a trend that the wedge ratio becomes smaller. The smaller wedge ratio implies that thickness of the comer of the Panel 1 becomes the thinner by the much, which implies that the panel 1 is susceptible to implosion even by a small impact. That is, as described, the smaller wedge ratio means a weaker comer portions, a wrong position determination under which state may lead the implosion protection band strapping, not to prevent the implosion, but to an opposite effect.

SUMMARY OF THE INVENTION

Accordingly, the present invention is directed to an implosion protection band for color cathode ray tube that substantially obviates one or more of the problems due to limitations and disadvantages of the related art.

An object of the present invention is to provide an implosion protection band for color cathode ray tube, in which a strapping position of an implosion protection band is improved for enhancing an implosion proof characteristics of a flat panel.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the implosion protection band for color cathode ray tube includes a panel with a wedge ratio of 1.1~1.8 and a substantially flat outer surface, wherein the implosion protection band is strapped around an outer circumference of the panel to satisfy a condition of $0.2 \leqq UW/LW \leqq 0.5$, where the UW denotes an upper band width and the LW denotes a lower band width with reference to an extension line from an inside surface of the panel at a center thereof.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Figure 1:
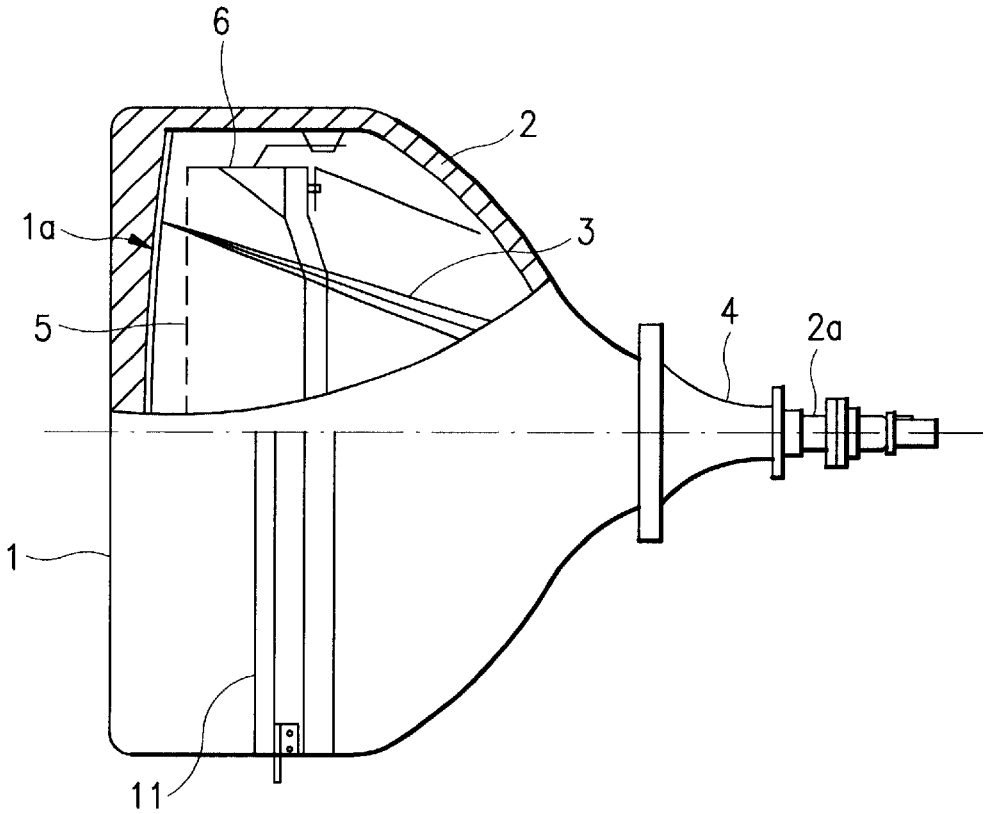
FIG.1 Related Art
FIG. 1 illustrates a side view of a related art color cathode ray tube with a partial cut away view.
Figure 2:
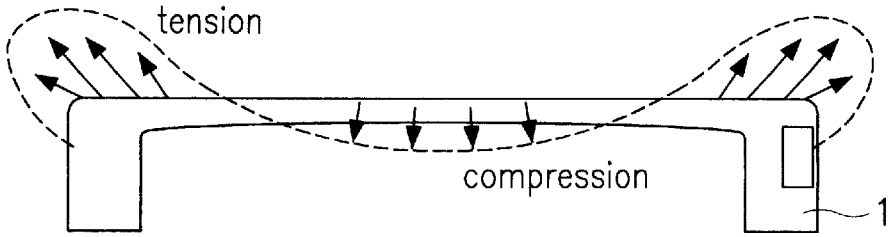
FIG.2 Related Art
FIG. 2 illustrates a stress distribution on a panel of a cathode ray tube under a vacuum, schematically.
Figure 3A:
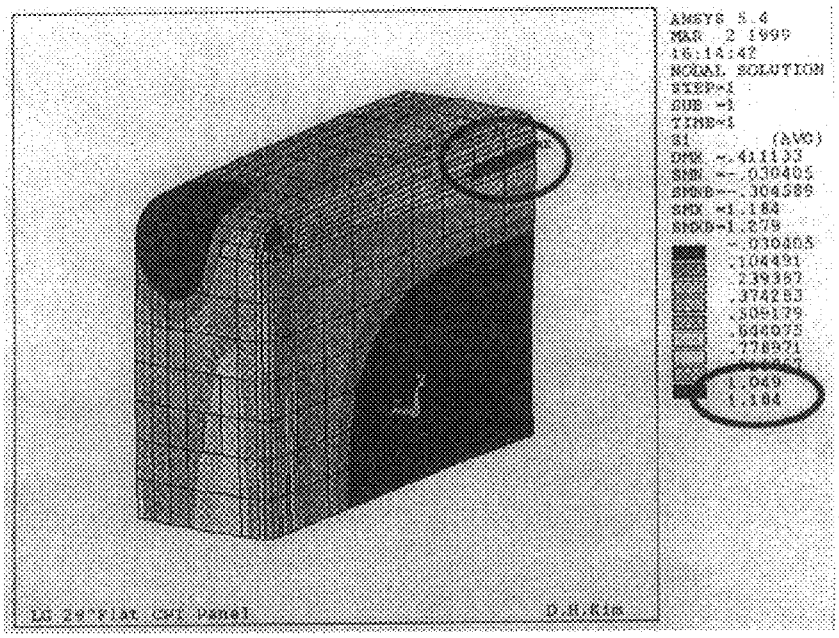
FIG.3A Related Art
FIGS. 3A and 3B illustrate stress simulations of a panel 1 of a cathode ray tube under high vacuum.
Figure 3B:
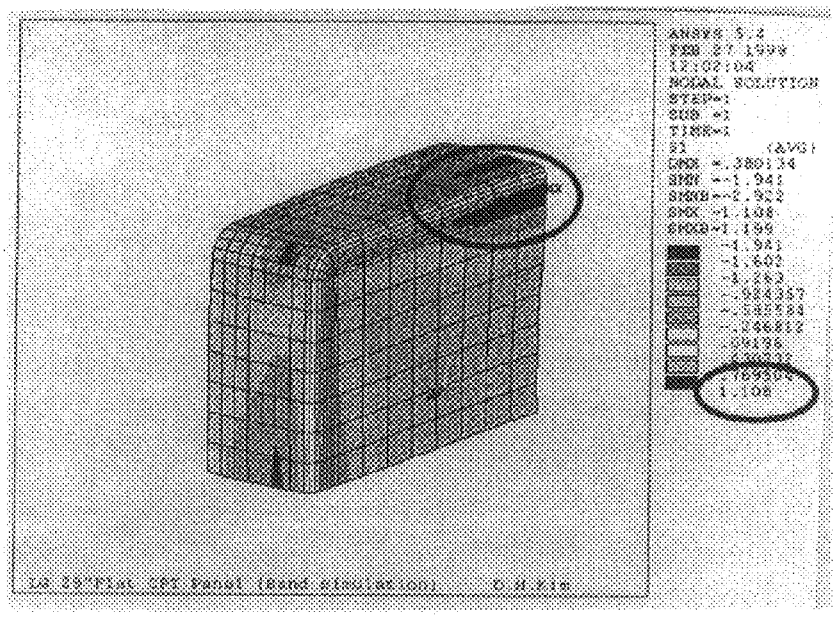
FIG.3B Related Art
Figure 4:
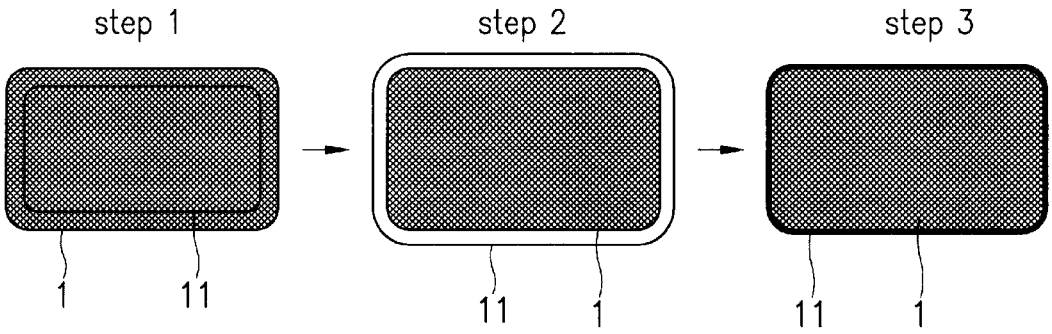
FIG.4 Related Art
FIG. 4 illustrates the steps of strapping an implosion protection band on an outer circumference of a panel.
Figure 5:
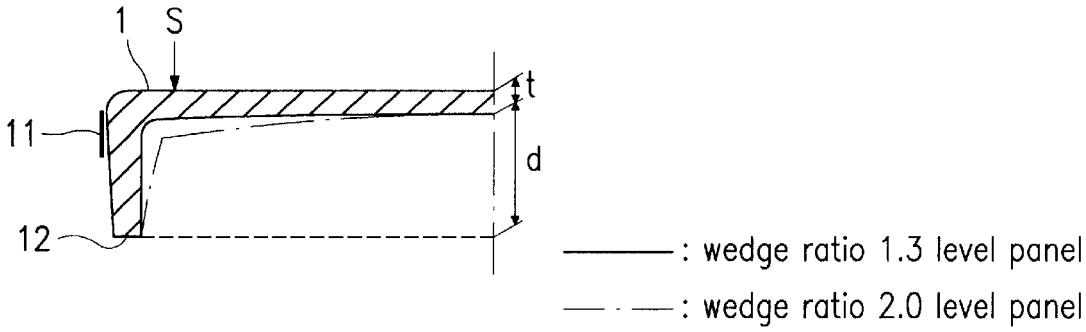
FIG.5 Related Art
FIG. 5 illustrates a partial section of panel for explaining a strapping position of the implosion protection band and a wedge ratio.
Figure 6:
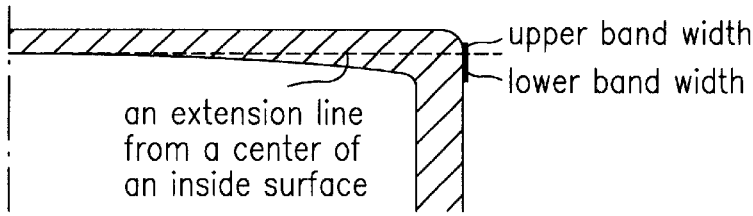
FIG. 6 illustrates a partial section of panel for explaining a strapping position of the implosion protection band and a wedge ratio in accordance with a preferred embodiment of the present invention.

Reference will now be made in detail to the preferred embodiments of the present invention, examples of which are illustrated in the accompanying drawings. The present invention suggests to strap an implosion protection band 11 around a Panel 1 with a wedge ratio of 1.1~1.8 and a substantially flat outer surface, in a strapping condition to meet 0.2≦upper band width /lower band width≦0.5, where the upper band width is an upper portion of the implosion protection band with reference to an extension line drawn from a center of an inside surface of the panel 1, and the lower band width is a lower portion of the implosion protection band with reference to the extension line. As shown in FIG. 5, it is preferable that the upper band width of the implosion protection band 11 is within a range of 0.63 t~t, where 't' is a thickness of the panel 1 at the center thereof. And, it is preferable that the lower band width of the implosion protection band is 0.31 d~0.52 d, where 'd' denotes a distance from the inside surface of the panel 1 at the center thereof to a sealing surface.

The foregoing will be explained in detail with reference to tables 1~3. Table 1 shows the lower band width vs. stress on a panel surface in a condition that an initial stress on the panel 1 caused by vacuum before the implosion protection band is strapped is set to be 1.184 Kgf/cm$^2$, and the upper band width of the implosion protection band is set to be 10 mm, where 'd' denotes a distance from the inside surface of the panel 1 at the center thereof to a sealing surface.

TABLE 1

Analysis of the implosion protection band (when the upper band width is set to be 10 mm)

| No. | Upper band width (mm) (UW) | Lower band width (mm) (LW) | LW/d | UW/LW | Stress on panel when implosion protection band is strapped (Kgf/cm$^2$) |
|---|---|---|---|---|---|
| 1 | 10 | 20 | 0.21 | 0.50 | 1.157 |
| 2 | 10 | 25 | 0.26 | 0.40 | 1.147 |
| 3 | 10 | 30 | 0.31 | 0.33 | 1.109 |
| 4 | 10 | 35 | 0.36 | 0.29 | 1.108 |
| 5 | 10 | 40 | 0.41 | 0.25 | 1.119 |
| 6 | 10 | 45 | 0.46 | 0.22 | 1.117 |
| 7 | 10 | 50 | 0.52 | 0.20 | 1.111 |
| 8 | 10 | 55 | 0.57 | 0.18 | 1.130 |
| 9 | 10 | 60 | 0.62 | 0.17 | 1.159 |

Figure 7:
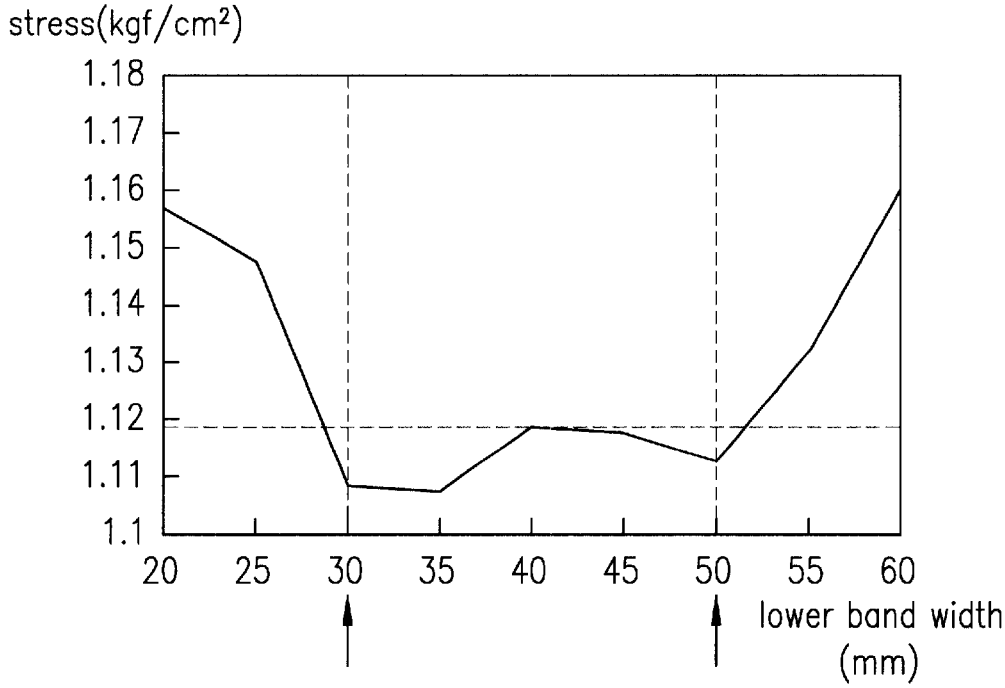
FIG. 7 illustrates a graph showing a lower width of an implosion protection band vs. a maximum stress of a panel when an upper width thereof is fixed to 10 mm in the present invention; and, FIG. 8 illustrates a graph showing a lower width of an implosion protection band vs. a maximum stress of a panel when an upper width thereof is fixed to 10 mm in the present invention.

That is, referring to table 1 and FIG. 7, it can be known that a stress is reduced by 5.5%~6.4% compared to an initial stress when the lower band width of the implosion protection band 11 is in a range of 30 mm~50 mm. Opposite to this, if the lower band width of the implosion protection band is either below 30 mm or greater than 50 mm, the stress is increased sharply, on the contrary.

Table 2 shows an upper band width vs. a stress on a surface of the panel in a condition that an initial stress on the panel 1 caused by vacuum before the implosion protection band 11 is strapped is set to be 1.184 Kgf/cm$^2$, and the lower band width of the implosion protection band is set to be 35 mm where the stress reduction is the most distinctive, where 't' in table 2 denotes a thickness of the panel 1 at the center thereof.

TABLE 2

Analysis of the implosion protection band (when the lower band width is set to be 35 mm)

| No. | Upper band width (mm) (UW) | Lower band width (mm) (LW) | UW/t | UW/LW | Stress on panel when implosion protection band is strapped (Kgf/cm$^2$) |
|---|---|---|---|---|---|
| 1 | 0 | 35 | | | 1.145 |
| 2 | 5 | 35 | 0.31 | 0.14 | 1.118 |
| 3 | 10 | 35 | 0.69 | 0.29 | 1.108 |
| 4 | 15 | 35 | 0.94 | 0.43 | 1.108 |

Figure 8:
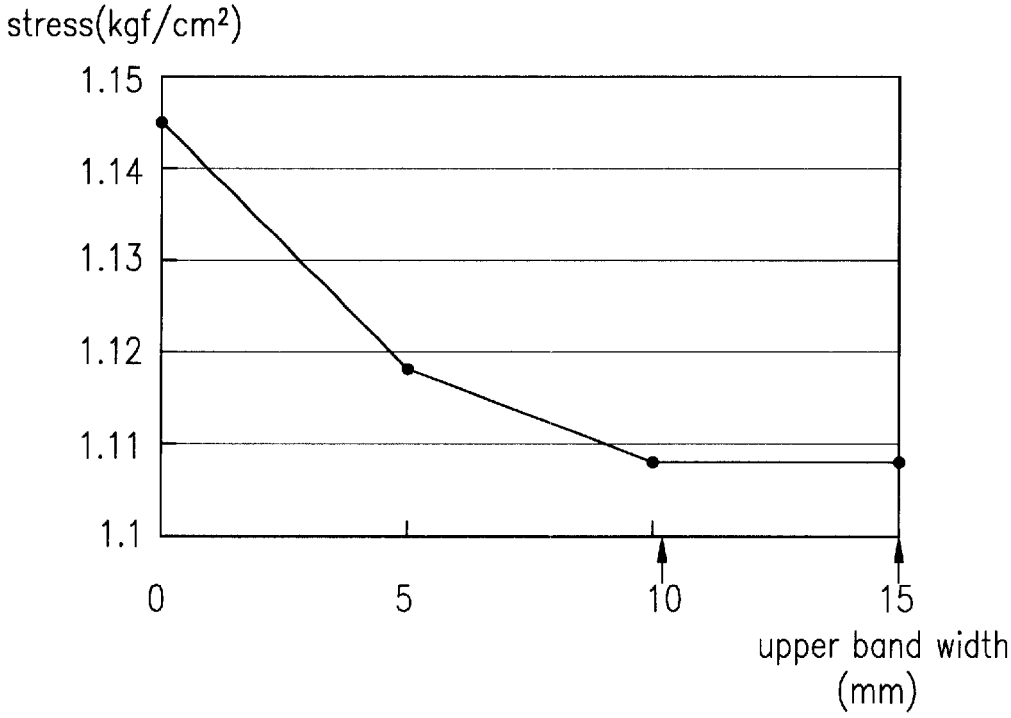

That is, referring to table 2 and FIG. 8, it can be known that the stresses are the same, and show the most improved values when the upper band widths of the implosion protection band 11 are greater than 10 mm. That is, it can be known that it is necessary to provide a great upper band width as far as the upper band width is not beyond the screen surface. The No. 1 case in table 1 shows a case when the upper band width of the implosion protection band 11 is not set, wherein it can be known that the stress is greater than the cases when the upper band widths are fixed. In the meantime, though not shown in the table, the stress on the Panel 1 is 1.160 Kgf/cm$^2$, when the upper band width of the implosion protection band 11 is set to be 0 mm, and the lower band width is set to be 65 mm. This is because fatigue in the vicinity of the comer can be increased since a center of compression is positioned away from the surface of the panel 1, though an amount of compression of the entire implosion protection band 11 is increased when the lower band width of the implosion protection band 11 is great excessively. That is, for enhancing an implosion proof characteristics, it can be known what is important is, not an increased compression of the implosion protection band, but setting of the upper band width and the lower band width of the implosion protection band to an appropriate ratio. For example, a panel with d=96 mm, and t=16 mm has an appropriate upper band width of 10 mm~15 mm, and an appropriate lower band width of 30 mm~50 mm, which satisfies the following inequality.

$$0.2 \leqq \text{upper band width/lower band width} \leqq 0.5$$

On the other hand, table 3 shows embodiments of the present invention. That is, after implosion protection bands as shown in table 3 are strapped on an outer circumference of a panel with a radius of curvature of an outer surface of the panel being 100,000 mm and a wedge ratio being in a level of 1.3, an implosion proof test is carried out(BALL TEST, 7J).

TABLE 3

| | Upper band width (mm) (UW) | Lower band width (mm) (LW) | UW/LW | Results |
|---|---|---|---|---|
| Embodiment 1 | 10 | 49 | 0.2 | OK |
| Embodiment 2 | 10 | 35 | 0.29 | OK |
| Embodiment 3 | 3 | 56 | 0.05 | N.G |

The case of embodiment 3 in table 3 is a case when the lower band width is set great excessively such that the implosion protection band 11 is strapped in the sealing surface side more than the screen surface side. As can be known from the foregoing embodiments, in a panel 1 with a small wedge ratio, for keeping the implosion proof characteristics good, the position of the implosion protection band should be shifted toward the screen side within a preset range compared to the position of the implosion protection band in the related art.

As has been explained, the present invention has the following advantages.

The implosion protection band for color cathode ray tube having a panel with a wedge ratio in a range of 1.3 of the present invention can reduce a maximum stress on the panel by approx. 5%~7% compared to the same in the related art and improve an implosion proof characteristics.

It will be apparent to those skilled in the art that various modifications and variations can be made in the implosion protection band for color cathode ray tube of the present invention without departing from the spirit or scope of the invention. Thus, it is intended that the present invention cover the modifications and variations of this invention provided they come within the scope of the appended claims and their equivalents.

What is claimed is:

1. An implosion protection band for a color cathode ray tube having a panel with a wedge ratio of 1.1~1.8 and a substantially flat outer surface, wherein the implosion protection band is strapped around an outer circumference of the panel to satisfy a condition of $0.2 \leqq UW/LW \leqq 0.5$, where the UW denotes an upper band width and the LW denotes a lower band width with reference to an extension line from an inside surface of the panel at a center thereof, and wherein the LW satisfies a condition of $0.31\ d \leqq LW \leqq 0.52\ d$, where 'd' denotes a distance from a center line of the inside surface of the panel to a sealing surface.

2. An implosion protection band as claimed in claim 1, wherein the UW satisfies a condition of $0.63\ t \leqq UW \leqq t$, where 't' denotes a thickness of the panel at the center thereof.

3. An implosion protection band for a color cathode ray tube having a panel with a wedge ratio of 1.1~1.8 and a substantially flat outer surface, wherein the implosion protection band is strapped around an outer circumference of the panel to satisfy a condition of $0.2 \leqq UW/LW \leqq 0.5$, where the UW denotes an upper band width and the LW denotes a lower band width with reference to an extension line from an inside surface of the panel at a center thereof, and wherein the UW satisfies a condition of $0.63\ t \leqq UW \leqq t$, where 't' denotes a thickness of the panel at the center thereof.

4. A color cathode ray tube having a substantially flat outer panel with a wedge ratio of between approximately 1.1 and approximately 1.8 and an implosion protection band that is strapped around the outer circumference of the panel, wherein the improvement comprises:

positioning the implosion protection band such that a position ratio UW/LW is between approximately 0.2 and approximately 0.5, wherein UW represents an upper width of the implosion protection band above an extension line extending from an inside surface of the center of the panel, and wherein LW represents a lower width of the implosion protection band below the extension line.

5. The color cathode ray tube as claimed in claim 4, wherein the LW is between approximately 0.31 d and approximately 0.52 d, wherein d denotes a distance from a center line of an inside surface of the panel to a sealing surface.

6. The color cathode ray tube as claimed in claim 5, wherein the UW is between approximately 0.63 t and approximately 1 t, wherein t denotes a thickness of the panel at a center thereof.

7. The color cathode ray tube as claimed in claim 4, wherein the UW is between approximately 0.63 t and approximately 1 t, wherein t denotes a thickness of the panel at a center thereof.

8. A color cathode ray tube having a substantially flat outer panel with an implosion protection band that is strapped around the outer circumference of the panel, wherein the improvement comprises:

positioning the implosion protection band such that it has lower width of between approximately 0.31 d and approximately 0.52 d, wherein d denotes a distance from a center line of an inside surface of the panel to a sealing surface, and wherein the lower width is the width of the implosion protection band below an extension line extending from an inside surface of the center of the panel.

9. The color cathode ray tube as claimed in claim 8, wherein the implosion protection band is positioned such that it has an upper width of between approximately 0.63 t and approximately 1 t, wherein t denotes a thickness of the panel at a center thereof, and wherein the upper width is the width of the implosion protection band above an extension line extending from an inside surface of the center of the panel.

10. A color cathode ray tube having a substantially flat outer panel with an implosion protection band that is strapped around the outer circumference of the panel, wherein the improvement comprises:

positioning the implosion protection band such that it has an upper width of between approximately 0.63 t and approximately 1 t, wherein t denotes a thickness of the panel at a center thereof, and wherein the upper width is the width of the implosion protection band above an extension line extending from an inside surface of the center of the panel.

* * * * *